United States Patent [19]

Merchant et al.

[11] Patent Number: 4,551,239

[45] Date of Patent: Nov. 5, 1985

[54] WATER BASED DEMULSIFIER FORMULATION AND PROCESS FOR ITS USE IN DEWATERING AND DESALTING CRUDE HYDROCARBON OILS

[75] Inventors: Philip Merchant, Houston; Sylvia M. Lacy, Pearland, both of Tex.

[73] Assignee: Exxon Research & Engineering Co., Florham Park, N.J.

[21] Appl. No.: 631,980

[22] Filed: Jul. 18, 1984

Related U.S. Application Data

[63] Continuation-in-part of Ser. No. 558,614, Dec. 6, 1983, abandoned, which is a continuation of Ser. No. 483,608, Apr. 11, 1983, abandoned.

[51] Int. Cl.[4] ..... C10G 33/02; C10G 33/04

[52] U.S. Cl. ..... 208/188; 208/187; 210/718; 210/728; 210/729; 210/732; 210/748; 252/358

[58] Field of Search ..... 208/188, 187; 252/358; 210/728, 732, 729, 730, 708, 748

[56] References Cited

U.S. PATENT DOCUMENTS

| | | | |
|---|---|---|---|
| 4,175,054 | 11/1979 | Tait et al. | 252/331 |
| 4,183,821 | 1/1980 | Langdon et al. | 252/331 |
| 4,209,374 | 6/1980 | Martin | 204/188 |
| 4,309,306 | 1/1982 | Blair, Jr. | 252/331 |
| 4,411,775 | 10/1983 | McCoy et al. | 208/188 |
| 4,416,754 | 11/1983 | Merchant, Jr. et al. | 210/748 |
| 4,439,345 | 3/1984 | Duke | 252/344 |

OTHER PUBLICATIONS

H. L. Greenwald, G. L. Brown, and M. N. Fineman, "Determination of the Hydrophile-Lipophile Character of Surface Active Agents and Oils by a Water Titration", *Analytical Chemistry*, vol. 28, No. 11, Nov. 1956, pp. 1693-1697.

*Primary Examiner*—D. E. Gantz
*Assistant Examiner*—Anthony McFarlane
*Attorney, Agent, or Firm*—Roland A. Dexter

[57] ABSTRACT

Oil is dehydrated and/or desalted by the influence of a dewatering and desalting formulation which can be characterized as an admixture of (i) a demulsifier preferably an alkylene oxide alkyl phenol-formaldehyde condensate such as a poly ethoxylated nonylphenol-formaldehyde condensate and (ii) a deoiler which is usefully a polyol such as ethylene glycol or poly (ethylene glycol) of $\overline{M}w$ ranging from 106 to 44,000 and preferably ethylene glycol.

The aqueous formulation may usefully contain a cosolvent such as isopropanol. The surface active agent composition is admixed with the salt-containing oil which has been emulsified with water, and heated whereby the formulation of surface active agents aids in breaking of the emulsion and transfer of salts to the aqueous phase preferably after passage through an electric coalescer whereby a clean oil product suitable for use in refining operations is recovered with remarkably low oil carry under with the effluent water when ethylene glycol is formulated into the system as the deoiler.

20 Claims, No Drawings

WATER BASED DEMULSIFIER FORMULATION AND PROCESS FOR ITS USE IN DEWATERING AND DESALTING CRUDE HYDROCARBON OILS

This application is a continuation-in-part of U.S. patent application Ser. No. 558,614, filed Dec. 6, 1983, now abandoned, which is a continuation of U.S. patent application Ser. No. 483,608, filed Apr. 11, 1983, now abandoned.

FIELD OF THE INVENTION

This invention relates to an aqueous composition utilized in a process for dewatering hydrocarbon oils and demulsifying hydrocarbon oil and water emulsions. More particularly, it relates to an aqueous formulation of demulsifier useful in the recovery of a desalted hydrocarbon crude exposed to the action of an electrocoalescer.

BACKGROUND OF THE INVENTION

The production of oil from underground reservoirs results in crude oil containing varying amounts of water generally in the form of a water-in-oil emulsion. It is general practice to dehydrate the crude oil by allowing it to stand but oftentimes the dehydration is enhanced by the addition of a demulsifier to break the emulsion facilitating physical separation of the crude oil from the water. Following this dehydration step, the crude oil is transported to the refinery where it may undergo an initial dewatering procedure and/or subjected to the process of desalting, i.e. the removal of salts from hydrocarbon crude oil, sometimes employing the action of an electrocoalescer.

Salts in hydrocarbon crude oil are generally dissolved in small droplets of water or brine dispersed throughout the crude. Sodium chloride is the primary salt followed by calcium chloride, magnesium chloride and the sulfates of these three metals. The total salt content ranges from substantially zero to several hundred pounds per thousand barrels of crude.

These brine droplets are generally prevented from coalescing and settling by a tough, elastic film at the surface of each droplet. This film is stabilized by natural emulsifiers found in the crude, solids, and solid hydrocarbons that concentrate at the droplet surface. A desalting chemical or demulsifier displaces these natural emulsifiers and solids and weakens the film so the droplets of brine can coalesce when they contact each other.

A new oil field will frequently produce crude with negligible water and salt. As production continues, the amount of water produced increases, raising the salt content of the crude. Additional salt contamination often occurs during tanker shipment. An empty tanker takes on sea water as ballast and often uses it to wash the tanks. To minimize pollution, the top, oily layer of ballast water and the washings are segregated in a slop compartment when the ballast water is discharged. Fresh crude is then loaded on top of this slop oil and water. The entire compartment is then offloaded at the refinery.

As earlier inferred, some brine can be removed by settling and water drawoff in the refinery's crude storage tanks. Some demulsifiers are very effective in increasing the rate and amount of settling as well as preventing sludge buildup and in cleaning tanks where sludge has already accumulated. Typically, the demulsifier formulation is injected into the turbulent crude flow as it fills the storage tank at a treat rate of from 10 to 500 ppm. The settled brine is drawn before the crude is charged to the pipestill.

The destructive effects of processing salt-contaminated hydrocarbon streams in refining operations have been well known for many years. These streams are heated for distillation or cracking effects and result in a decomposition of the salt into hydrochloric acid. Hydrochloric acid causes severe damage and lost on-stream time in a refinery due to its very highly corrosive attack on metal processing equipment. Consequently, the removal of salt from crude oil (and its products) has been a major refining problem. A process was formed in the 1930's for the removal of the salt which contaminated hydrocarbon streams, such as crude oil. This process is described in U.S. Pat. No. 2,182,145. In this desalting process, the hydrocarbon stream is mixed with a small amount of fresh water (e.g. 10% by volume) forming a water-in-oil emulsion. The resulting emulsion is subjected to an electric field wherein the water is coalesced as an under flow from the upper flow of a relatively water-free, continuous hydrocarbon phase. The desalted hydrocarbon stream is produced at relatively low cost and has a very small residual salt content.

To enhance the effectiveness of electrostatic desalter, desalting chemicals are used in combination with an imposed electric field. Desalting chemicals are usually a blend of surface active materials in hydrocarbon solvents. These materials are preferentially absorbed at the brine droplet surface, displacing the solids and natural emulsifiers. This greatly weakens the film around the droplets. The brine droplets can then coalesce with the wash water (thus diluting the brine) and with other droplets so their size becomes large enough to settle by gravity. Depending on its composition and solvent, the desalting chemical may also dissolve the film.

To overcome solids stabilization of an emulsion, a good demulsifier formulation will cause the oil-wet solids to become water-wet and settle into the water phase where they are removed with the effluent water. A surfactant can also be used alone or in combination with the demulsifier for this purpose. These chemicals work by attaching an oil-loving or solids-loving section of the molecule to an oil-wetted solid. A water-loving section then physically drags the solid into the water phase. These molecules can also agglomerate solids to speed their settling. Without chemical treatment, most oil-wet solids will stay in the oil phase even though their density is higher.

A good demulsifier formulation will perform as follows. It will efficiently break the emulsion into oil and water phases. The rate will be fast enough in electrostatic desalting operations to prevent emulsion pad buildup which can short out the electrodes of the electrocoalescer and result in emulsified oil rather than an oil with reduced salt content going to the distillation tower and/or cause excessive oil carryunder. The water and salt will be removed from the oil within the residence time of the desalter. Minimal oil, i.e. known as oil carryunder, will be present in the effluent water which flows from the bottom of the coalescer. Solids will be water wet so they are similarly removed from the crude. Further the chemical must be able to treat many different crudes effectively. Finally the desalting system as formulated should not be a hazard to operations, e.g. it should have a flash point of at least 38° C.

Both the dewatering and desalting demulsifier formulations must be sufficiently stable during storage and/or use that stratification of the formulation does not occur. Stratification is highly objectionable since it causes a drastic and unacceptible reduction of demulsification efficiency. Also highly objectionable for a demulsifier formulation is a tendency to foam since the presence of foam results in a decrease of effective operating capacity and/or increases the stability of the emulsion being treated. Further, the formulation must be cost effective.

It is, accordingly, the primary object of the present invention to obviate these and other prior art deficiencies, particularly by providing novel demulsifier formulations and processes for dewatering and/or desalting conventional whole heavy petroleum crudes, heavy petroleum crude fractions, residua, fuel oils and refinery hydrocarbon fractions (all of which are herein collectively called "hydrocarbon oil").

SUMMARY OF THE INVENTION

It has been discovered that an aqueous solution of the combination of from 1 to 1.5 weight parts of a water soluble polyol, such as ethylene glycol or a poly(oxyethylene glycol) of $\overline{M}w$ about 600, per weight part of a water soluble demulsifier such as an alkoxylated alkyl phenol-formaldehyde adduct having eight to twenty-five moles of alkylene oxide per mole of alkyl phenol-formaldehyde are a highly effective water based demulsifier formulation particularly useful for dewatering and desalting processes including both static and dynamic processes with the latter generally utilizing an electrocoalescer desalter. For reasons not fully understood the presence of the polyol dramatically and unexpectedly reduced the oil carryunder, i.e. a deoiler effect of the aqueous phase or effluent.

In accordance with this invention there is provided an aqueous formulation suitable for the dewatering of a hydrocarbon oil comprising the combination of (i) a deoiler such as ethylene glycol, propylene glycol or a poly(alkylene glycol) of $\overline{M}w$ ranging from 120 to 4,500, preferably 300–1,000, optimally about 600 and mixtures thereof and (ii) at least one water-soluble demulsifier such as a water-soluble alkylene oxide alkyl phenol-formaldehyde condensate having a Relative Solubility Number (hereinafter indicated as RSN) of 13 to 30, the weight ratio of (i) to (ii) ranging from 1:20 to 20:1, preferably 1:5 to 5:1, optimally 1:1 to 1.5:1.

Thus in accordance with this invention there is provided a process for separating water from a hydrocarbon oil which comprises (a) dispersing from 1 volume part per million to 1000 volume parts per million of a water soluble demulsifier into a hydrocarbon oil containing water, and (b) recovering a dehydrated oil, said demulsifier having an RSN ranging from 13 to 30. As used herein all parts per million are based on volumes.

Further in accordance with this invention there is provided a preferred process for desalting a hydrocarbon oil, which comprises (a) dispersing from 2 parts per million (hereinafter referred to as ppm) to about 50 ppm of an aqueous admixture of at least one water-soluble deoiler and at least one water-soluble demulsifier within an aqueous emulsion of said oil, the deoiler preferably being a polyol represented by the formula $$HO\left(CH_2-\underset{\underset{R}{|}}{CH}-O\right)_n H$$

wherein R is H or $CH_3$ and n is an integer ranging from 1 to 100, and optimally being ethylene glycol, and the demulsifier being an alkylene oxide alkyl phenolformaldehyde condensate having an RSN of 17 to 20 and (b) recovering a clean oil product containing less than 5, preferably less than 1 pounds of salt per thousand barrels of crude.

More specifically this invention is realized in an aqueous formulation comprising about 21% by weight of a ethoxylate of a nonyl phenol-formaldehyde condensate having 10 moles of ethylene oxide per mole of phenol-formaldehyde adduct, about 18 weight percent of a poly(ethylene glycol) having a $\overline{M}w$ of about 600, about 3 to 4 weight percent of isopropanol (as a cosolvent) and the balance water, said weight percent based on the total weight of the formulation.

In its preferred form there is provided an aqueous formulation of ethylene glycol present in about 25 weight percent, a phenol formaldehyde resin condensate with 10 moles of ethylene oxide per mole of phenol formaldehyde resin present in about 25 weight percent and the balance is water.

DETAILED DESCRIPTION OF THE INVENTION

The water based dewatering and/or desalting chemical formulation is based on the presence of at least one deoiler or at least one water soluble demulsifier and generally most usefully the combination of at least one deoiler, e.g. a polyol and at least one water soluble demulsifier with optionally a cosolvent.

I. Deoiler

Useful deoilers which provide the Merchant-Lacy Effect include those polyhydric alcohols which are water soluble, have a total of 2 to about 100 carbon atoms and can be represented by the formula:

$$X_1-\overset{\overset{X_2}{|}}{\underset{\underset{X_3}{|}}{C}}-CH_2OH$$

wherein: $X_1$ is hydrogen, hydroxy $C_1$ to $C_5$ alkyl, hydroxy alkyl $[HO(CH_2)_n]$ wherein n is 1–50; and hydroxyalkoxy $[HO(CH_2CH_2O)_n-CH_2CH_2O,]$ wherein n is 1–50, and $X_2$ and $X_3$ may be the same or different and each represents hydrogen, hydroxy, $C_1$ to $C_5$ alkyl and $C_1$ to $C_5$ hydroxyalkyl groups and their ester, ether, acetal or ketal derivatives and mixtures of said deoilers.

Particularly useful polyols which can be used alone or as mixtures are generally of the formula:

$$HO\left(CH_2-\underset{\underset{R}{|}}{CH}-O\right)_n H$$

wherein R is H or $CH_3$ and n is an integer ranging from 1 to 100 and the alkoxylated derivatives thereof including the ethoxylated, propoxylated and mixed ethoxylated-propoxylated derivatives. The polyols wherein n ranges from 2 to 100 can be described as poly(oxyalkylene glycol)s and appear to be described in U.S. Pat. No. 2,552,528 (col. 10). For these water-soluble poly(oxyalkylene glycol)s the $\overline{M}w$ ranges from 106 to 44,000 preferably from 300 to 1,000 and optimally about 600. These polymers are readily formed from an alkylene oxide such as ethylene and/or propylene oxide. When n is one the polyol is ethylene glycol or propylene glycol.

In the desalting process, particularly a continuous electrocoalescent type, it has been found that the polyol acts as a deoiler of the effluent water exhibiting a hitherto unknown influence on the entrained oil ordinarily carried into the water phase so that the oil carryunder of said effluent water is markedly reduced e.g. from 6% volume to less than 1% volume. This property which has been named the Merchant-Lacy Effect is manifested by a marked reduction in oil entrained with the dropped water, i.e. reduced carryunder of oil in electrostatic desalting processes. The Effect is particularly notorious when a water-soluble demulsifier is used in combination with ethylene glycol.

The deoilers useful herein are water-soluble, i.e. at least soluble in 5% by weight of water at 25° C.

In addition to the polymers referenced above the polyols are typified by glycerol, ethylene glycol, pentaerythritol, dipentaerythritol, sorbitol, mannitol, cyclohexaamylose, cycloheptaamylose and related polyhydric alcohols such as those prepared via the aldol condensation of formaldehyde with ketones such as acetone, and cyclohexanone and glycol ethers including ethylene glycol monoethyl ether, ethylene glycol monobutyl ether and ethylene glycol monopropyl ether.

II. Demulsifier

The demulsifier must be water-soluble which for purposes of this discussion means at least 5% by weight dissolves into water at 25° C. and must have an RSN of from 13 to 30, preferably from 17 to 20 and optimally 18 to 19. RSN is a measure of the amount of water required to reach the cloudpoint at 25° C. of the solution of 1 gram of demulsifier dissolved in 30 ml of a solvent system made up of 4% xylene in dioxane and is based on the hydrophile-lipophile character of surface active agents (see H. N. Greenwold et al's article appearing in Analytical Chemistry, Vol. 28 Nov. 11, November, 1956 on pages 1693–1697).

The demulsifier acts at the interface of the water and oil to provoke coalescence of the water drops dispersed throughout the continuous oil phase of the water-in-oil emulsion treated according to this invention.

These demulsifiers are well known in the art, and include, for example, oxyalkylated amines, alkylaryl sulfonic acid and salts thereof, oxyalkylated phenolic resins, polymeric amines, glycol resin esters, polyoxyalkylated glycol esters, fatty acid esters, oxyalkylated polyols, low molecular weight oxyalkylated resins, bisphenol glycol ethers and esters and polyoxyalkylene glycols. This enumeration is, of course, not exhaustive and other demulsifying agents or mixtures thereof will occur to one skilled in the art. Most demulsifiers which are commercially available fall into chemical classifications such as those enumerated above. The exact composition of a particular compound and/or its molecular weight is usually a trade secret, however. Despite this, one skilled in the art is able to select demulsifiers using general chemical classifications provided it exhibits an RSN of from 13 to 30.

These demulsifiers preferably are of the class of poly oxyalkylated adducts of a water-insoluble aromatic hydrocarbon solvent-soluble synthetic resin (which for purposes of this disclosure will be referred to as oxyalkylated alkyl phenol-formaldehyde resins), oxyalkylated amines, glycol resin esters, bisphenol glycol ethers and esters and alkyl aryl sulfonic acids and salts thereof.

The oxyalkylated alkyl-phenol formaldehyde resins which are preferred for use in this invention are of the general class of water soluble alkylene oxide alkyl phenol formaldehyde condensates and can be characterized as follows:

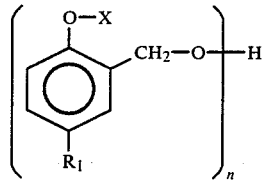

wherein X represents one or more ethoxy or propoxy groups, or mixed ethoxy and propoxy groups, and $R_1$ is a $C_3$ to $C_{15}$, preferably $C_4$ to $C_9$, alkyl group. In the formula, n is an integer of 1 or greater than 1, and the molecular weight of the demulsifier, or resin, generally ranges from about 500 to about 10,000 preferably from about 1,000 to about 6,000. The resin can be unmodified, or modified as by substitution or addition of substituents in the side chains or nucleus of the aromatic constituents of the molecules, especially by reaction at one or both terminal nuclei or esterification with an organic acid, e.g. tall oil fatty acid.

This preferred class of demulsifiers are well known from such disclosures as U.S. Pat. No. 3,640,894 (cols. 5 and 6) and U.S. Pat. No. 2,499,365 and typically include ethoxylated adducts of the p-nonyl phenol formaldehyde resin having a molecular weights of from 500 to 10,000 and ethoxylated propoxylated adducts of other $C_8$ to $C_{12}$ alkyl phenol formaldehyde resins having a molecular weight of from 2,000 to 6,000.

The glycol resin esters are derived from alkyl phenol formaldehyde resins having molecular weights of 500 to 5,000 which are alkoxylated and thereafter esterified by reaction with an ethyleneically unsaturated dicarboxylic acid or anhydride such as maleic anhydride. Such glycol resin esters are typified by an ethoxylated-propoxylated $C_4$–$C_9$ alkyl phenol formaldehyde resin glycol esters having a $\overline{M}w$ within the range of 2,000 to 8,000.

The bisphenol glycol ethers and esters are obtained by the alkoxylation of bisphenol A to molecular weights of from 3,000 to 5,000 and for the esters the ether products are esterified by reaction with organic acids such as adipic, acetic, oxalic, benzoic and succinic including maleic anhydride.

The salts of alkyl aryl sulfonic acids include those of ammonium, sodium, calcium, and lithium. The useful alkyl aryl sulfonic acids can be obtained by the sulfonation of alkyl substituted aromatic hydrocarbons such as those obtained from the fractionation of petroleum by distillation and/or extraction or by the alkylation of aromatic hydrocarbons as, for example, those obtained by alkylating benzene, toluene, xylene, naphthalene, diphenyl and the halogen derivatives such as chlorobenzene, chlorotoluene and chloronaphthalene. The alkylation may be carried out in the presence of a catalyst with alkylating agents having from about 3 to about 15, preferably 9–12, carbon atoms. Preferred sulfonic acids are those obtained by the sulfonation of hydrocarbons prepared by the alkylation of benzene or toluene. The alkaryl sulfonates contain from 7–21 carbon atoms, preferably from 15–18 carbon atoms per alkyl substituted aromatic moiety. Particularly preferred is the acid and sodium salt of a 12 carbon alkyl benzene sulfonic acid known as dodecyl benzene sulfonic acid.

Oxyalkylated amines are represented by the ethylene oxide, propylene oxide and mixtures of ethylene/butylene oxides derivatives of organic amines such as ethylene diamine, ethyl amine, propyl amine, aniline and alkylene polyamines.

The demulsifier formulation which is an admixture of (i) deoiler, e.g. the polyol and (ii) demulsifier should be such that the weight ratio of i:ii ranges from 1:20 to 20:1, preferably 1:5 to 5:1, optimally 1:1 to 1.5:1.

The concentration of the admixture for dewatering and desalting of the water in oil emulsion should be at least 1 part per million (hereinafter ppm) to 10000 ppm based on the total weight of the emulsion with a range of 1 ppm to 5000 being generally useful; however for a desalting application in electrostatic desalters a range of 1 ppm to 50 ppm is useful with 2 ppm to 30 ppm preferred and 3 ppm to 15 ppm optimal. Noteworthy is the deoiling effect of the polyol which in an effective amount appears to be at least 1 ppm however a range of 2 to 50, generally more like 5 to 25, ppm is useful when used in combination with the water soluble demulsifier described herein. Mixtures of demulsifiers and mixtures of polyols are within the scope of this disclosure. Further, it has been noted that the rate of demulsification does not appear to moderate the surprising decreased oil carry under property of the admixture mixture which has for purposes of this disclosure been primarily attributed to the deoilers influence on the coalescing water to purge itself of the oil.

III. Cosolvent

The cosolvent is used in the preferred formulations to mutually solubilize the surfactant and demulsifier in the water and as a solvating agent in the demulsification/-desalting process. Suitable cosolvents include $C_3$ to $C_{10}$ alkanols, including the preferred isopropanol and also aliphatic amines such as ethylene diamine and diethylene triamine, and ethanol amines including diethanol amine.

The water content of the formulation generally ranges from 20 to 80, preferably 30 to 60, optimally about 57, weight percent of the total formulation.

The surfactant and demulsifier may be dissolved into the water using, if desired, the cosolvent. Usefully, the cosolvent can be used to first wet or dissolve the polyol and/or demulsifier prior to the introduction of each into the water. The temperature of the water can be elevated to enhance dissolution.

IV. Desalting Process

Desalting is a washing operation where crude oil and water are deliberately emulsified so the tiny brine droplets and solids in the crude can be contacted and diluted with the wash water. Normally 4% to 5% wash water is used. The emulsion is created by turbulence across a partially closed valve injecting the wash water into the crude oil stream. The emulsion is then broken into oil and water phases using an electrostatic field, desalting chemical, heat and time. Most of the salts and solids are removed with the water. In processes where even low salts and solids are harmful, the crude may be double desalted. For example, double desalting protects the sulfur-removal catalyst and minimizes sodium content in Low Sulfur Fuel Oil units.

A typical desalter is a horizontal cylinder 10 to 14 feet in diameter and up to in excess of 100 feet long. Depending on the design, desalters can operate at pressures up to 500+ psig. Pressure must be sufficient to prevent vaporization of the water and/or flashing of lighter fractions of crude oil at the operating temperature. Vapor in the desalter is undesirable since an arc from the high voltage electrodes can cause an explosion. This means that the desalting formulation must be environmentally safe, e.g. it should have a flash point >38° C. which results in a significant advantage for the water based desalting formulation of the invention over the hydrocarbon based systems generally in use.

The maximum temperature is generally limited to 163° C. so that equipment failure will be minimized. The operating temperature is achieved by preheating the crude feed with exchangers before the mix valve. The desalter vessel is insulated and rarely loses more than 4° C. from inlet to outlet. Thermal gradients are undesirable since convection currents would hinder settling and cause non-uniform residence time. Electro-static coalescers of suitable type are described, e.g., in "Chemical Engineering Progress" vol. 61, no. 10, October 1965 at Pages 51–57 in an article by Logan C. Waterman. Commercial units are available from Petrolite Corporation and Howe Baker.

It is required to form an emulsion between the crude oil and the wash water, which creates a large interfacial area between the oil and water phases. The principles for the formation of oil and water emulsions are well known. The presence of natural surfactants in the crude oil significantly lowers the interfacial tension of the oil against water due to the concentration of the surfactant at the oil/water interface and promotes emulsification between the oil and water faces. On the other hand, the formulation of the invention, at least to a major extent, breaks the oil/water emulsion by removing the oil film from around the solids particles, and cleans the water phase of oil. In the instant situation, the deoiler of this invention may clean the surfaces of the solids and aid in the transfer of these solids to the water phase. The demulsifier causes the small water droplets to coalesce, and at the same time cleans, or purges, the oil from the water phase. The deoiler appears to wet and clean the surfaces of the oil solids, and the demulsifier is similarly effective in breaking the oil and water emulsion however the combination is surprisingly effective in removing and transferring oil from the water phase to the oil phase as evidenced by the reduced oil carry under.

Water is added to the crude oil generally in concentration ranging from about 1 percent to about 15 percent, preferably from about 3 percent to about 6 percent, based on the volume of the oil. The oil and water are then emulsified, as by shearing the oil and water in a mixer. The formed emulsion is subjected to the influence of the desalting formulation of the invention although the formulation is introduced into the crude oil or water prior to emulsification. The presence of the introduced deoiler water-wets and cleans the oil from the particles and transfers these solids to the oil phase. The action of the demulsifier causes the small drops of water to coalesce and cleans the oil from the water phase. Upon gravity settling, preferably at elevated temperature which is helpful in breaking the emulsion, the salt containing water phase clearly separates from the oil phase.

In the desalting of low gravity hydrocarbon oils or oils which are susceptible to oil carryunder, the deoiler is necessary to decrease or prevent oil carryunder with the water effluent. In contrast to the above, the deoiler is usually not necessary for the desalting of hydrocarbon oils having an API gravity higher than about 25.

In a preferred embodiment, the washwater is introduced through a mixing valve located downstream of the oil storage tank and upstream of the heat exchanger (it provides the desired heating of the crude oil) and in an optimal configuration a substantial portion of the wash water (from 40 to 70%) is introduced through a second mixing valve located downstream of the heat exchanger and upstream of the electrostatic coalescer. The extent of and nature of the blending of the formulation into the crude oil affects the desalting efficiency of the process. Conventionally the introduction of the formulation has been as far ahead of the desalter as possible. When processing crude, good mixing of the desalting blend with crude is difficult to achieve especially for low API gravity crudes. It has been found that the formulation markedly improves desalting efficiency when injected via the wash water either before or after the heat exchanger or in both portions of the wash water when two of said injections are used.

The disclosure of this invention is highly applicable to processes where the oil and water emulsion is transported, or flowed, into an electrostatic coalescer to form a clean oil phase overflow and salt containing water phase underflow with dramatically lowered oil carry under; or where the whole heavy crude petroleum oil or petroleum fraction contains a particularly high concentration of solids, the oil and water emulsion can be treated initially by gravity settling to effect partial separation (dewatering) of the salt containing water phase, and the remaining emulsion and/or oil phases further treated in an electrostatic coalescer, or staged series of electrostatic coalescers.

As noted, the formulation of the invention is conveniently introduced with the wash water injection into the crude oil prior to its introduction into the electric field and generally upstream and/or downstream of the heat exchanger whereby the emulsion is heated to 35° C. to 150° C., preferably from about 110° C. to about 145° C. The amount of formulation introduced can be from 1 to 1,000 generally 2 to 50, preferably 3 to 30, optimally about 10, ppm based on the weight of the crude oil. Chemical desalting is carried out at a temperature of from 35° to 150° C., preferably 110° to 145° C., for a period of 5 to 60, preferably 15 to 35, minutes. A clean oil overflow is removed from the top of the electrostatic coalescer while a salt containing aqueous stream underflow is removed from the bottom of said coalescer.

V. Dewatering Process

Dewatering of hydrocarbon oil is primarily carried out in the refinery tanks as a static process where comparable levels of demulsifier or demulsifier and deoiler according to this invention are generally introduced by injection into the line downstream of the tanker and upstream of the holding tank. In the dewatering process water levels in hydrocarbon oils are reduced from about 1–10 volume percent down to a dehydrated level of less than 1% volume in a static settling process.

Dewatering is a process to reduce the basic sediment, water and salt content of hydrocarbon oils. As taught herein, the dewatering process is applicable to both wet hydrocarbon oils i.e. oil which contains more than 1 volume percent of water and to dry hydrocarbon oils, i.e. oil which contains less than about 1 volume percent of water. For wet hydrocarbons oils the demulsifier or demulsifier and deoiler formulation is injected upstream of the tank containing the wet emulsion and thereafter dispersed throughout the wet oil which preferably contains more than 2 volume water. For dry hydrocarbon oils, the demulsifier or demulsifier and deoiler formulation according to this invention can be added to either the dry oil directly or dissolved into the requisite wash water which is added to an amount ranging from 2 to 10 volume percent based on the volume percent of the hydrocarbon oil to reduce the salt content of the dry hydrocarbon to less than five pounds of salt per 1000 barrels of hydrocarbon oil.

The following examples, and comparative demonstrations are further exemplary, particularly of the high effectiveness, of the admixture of this invention and process in removing salt from whole heavy crude petroleum and fractions and residua thereof. In the Examples, all parts are in terms of weight units except as otherwise specified, residence times in terms of minutes and temperatures in terms of degrees centigrade and molecular weights measured by gel permeation chromatography.

EXAMPLE 1

This Example demonstrates the effectiveness of the additive formulation in removing salt from a commercially produced crude oil which was a mixture of California produced crudes that had a Gravity, °API, of 17.5 with a salt content of 50 pounds per thousand barrels of crudes as measured by titration of the chloride content.

This mixture of California crudes was processed in a commercial desalter at a temperature of 138° C. with a residence time of about 20 minutes. About 3% wash water (based on crude volume) was used to emulsify said mixture.

The desalting formulation of the invention hereinafter defined as PMSL1 as used in this Example 1 was formulated of 21.4% nonyl phenol-formaldehyde adduct ethoxylated with 10 moles of ethylene oxide and having a $\overline{M}w$ of about 5,000, 17.9% of poly(ethylene glycol) having a $\overline{M}w$ of 600, 3.5% of isopropanol and the balance water. The PMSL1 formulation was injected into the crude oil prior to the heat exchanger of the desalter at a rate of about 20 ppm. The desalted crude oil had a salt content of less than 3 pounds per thousand barrels.

Static Desalting Evaluation Procedure

This procedure compares chemical effectiveness in breaking a crude oil/wash water desalter emulsion. Test conditions such as temperature, emulsion stability, the strength and duration of the electrostatic field, and chemical treat rate are selected to make differences in chemical performance the controlling factor. The rate and amount of emulsion broken within a short time period, the nature of the remaining emulsion, and the general quality of the water layer are determined.

EXAMPLE 2

The procedure of Example 1 was followed except that another formulation PMSL2 was used which consisted of 25% by weight of the adduct of Example 1 and 25% by weight of ethylene glycol dissolved in water.

The desalted crude had a salt content of less than 3 pounds per thousand barrels.

EXAMPLES 3-6

A series of aqueous formulations according to the invention containing variations in demulsifier and deoiler were evaluated with respect to both light and heavy crudes in a static desalting test measuring the rate of demulsification of a crude oil emulsion containing 5 weight percent water.

The formulations were as follows:

| No. | Component | RSN | % by weight |
|---|---|---|---|
| PMSL 3 | sorbitan monoleate | 18.5 | 25 |
| | ethoxylated resin* | | 25 |
| | water | | 50 |
| PMSL 4 | ethoxylated (20 moles) | 18.5 | 25 |
| | sorbitan trioleate | | 25 |
| | ethoxylated resin* | | 25 |
| | water | | 50 |
| PMSL 5 | glycerol | 18.5 | 25 |
| | ethoxylated resin* | | 25 |
| | water | | 50 |
| PMSL 6 | ethylene glycol mono- | ~25 | 15 |
| | butyl ether | | 20 |
| | isopropyl alcohol | | 15 |
| | dodecyl benzene | | 50 |
| | sulfonic acid | | |
| | water | | |

*this is p-nonyl phenol formaldehyde resins having 10 moles of ethylene oxide condensed onto each mole of resins having Mw range of 3,000 to 5,000.

The static desalting tests were carried out by emulsifying the crude oil with 5 weight percent water by vigorous agitation for 5 seconds at a temperature of about 85° C., thereafter adding 9 ppm of the formulation and subjecting the emulsion to a 2,000 volts potential for 10 seconds and thereafter measuring the water drop.

The results for a light crude oil were:

| | water drop provoked by Sample | | | | |
|---|---|---|---|---|---|
| time (min.) | PMSL 2 | PMSL 3 | PMSL 4 | PMSL 5 | PMSL 6 |
| initial | 14 | 37 | 9 | 11 | 2 |
| 1 | 17 | 51 | 23 | 37 | 3 |
| 2 | 20 | 51 | 29 | 46 | 5 |
| 3 | 20 | 54 | 34 | 46 | 7 |
| 5 | 26 | 60 | 37 | 51 | 9 |
| 10 | 29 | 60 | 43 | 57 | 17 |

The results for a waxy heavy crude oil were:

| | % water drop provoked by Sample | | | |
|---|---|---|---|---|
| time (min.) | PMSL 2 | PMSL 3 | PMSL 4 | PMSL 5 |
| initial | 0 | 0 | 0 | 0 |
| 1 | 3 | 0.2 | 6 | 0 |
| 2 | 9 | 0.3 | 9 | 0.3 |
| 3 | 11 | 0.4 | 11 | 0.6 |
| 5 | 14 | 0.7 | 20 | 17 |
| 10 | 29 | 1.1 | 31 | 34 |

The above data indicates that the several formulations (all within the scope of this invention) are useful in resolving an oil-water emulsion when said emulsion is under the influence of a static electrostatic field. As earlier indicated the higher the rate or amount of emulsion resolved, i.e. the % water drop, the more chemically effective is the form.

EXAMPLE 7

In the operation of a refinery desalter it was found that introduction of a formulation according to this invention in amounts ranging from 6 to 9 ppm decreased oil carryunder, as measured by the volumetric oil content of the effluent water phase, from the 5% normally seen with oil based desalting formulations to less than 1%.

The invention in its broader aspect is not limited to the specific details shown and described and departures may be made from such details without departing from the principles of the invention and without sacrificing its chief advantages.

We claim:

1. A process for reducing oil entrainment by effluent water derived from the breakdown of a water in oil emulsion comprising the step of adding at least an effective amount of: a deoiler having the formula

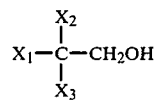

wherein: $X_1$ is hydrogen, hydroxy $C_1$ to $C_5$ alkyl, hydroxy alkyl $[HO(CH_2)_n]$ wherein n is 1-50, and hydroxyalkoxy $[HO(CH_2CH_2O)_n—CH_2CH_2O,]$ wherein n is 1-50; and $X_2$ and $X_3$ may be the same or different and each represents hydrogen, hydroxy, $C_1$ to $C_5$ alkyl and $C_1$ to $C_5$ hydroxyalkyl groups and their ester, ether, acetal or ketal derivatives; and, mixtures of said deoilers.

2. A process according to claim 1 wherein said deoiler has the formula

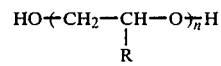

wherein R is H or $CH_3$ and n is an integer ranging from 1 to 1000.

3. The process according to claim 2 wherein said polyol is ethylene glycol and said amount added ranges from 1 to 1000 parts per million based on the total weight of said emulsion.

4. The process according to claim 1 wherein said breakdown is by means of a demulsifier which is a member of the class of polyalkylene oxide adducts of aromatic, hydrocarbon solvent-soluble synthetic resins oxyalkylated amines, glycol resin esters, bisphenol glycol ethers and esters and salts of alkyl aryl sulfonic acid and mixtures of the foregoing.

5. A process for desalting an oil characterized as conventional whole petroleum crudes, petroleum crude fractions and residua, which comprises (a) dispersing from 1 ppm to about 1000 ppm of an aqueous admixture of at least one demulsifier and at least one deoiler within said oil, the demulsifier being a water-soluble alkylene oxide alkyl phenol-formaldehyde condensate having a Relative Solubility Number ranging from 13 to 30 and a deoiler having a formula

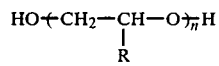

wherein R is H or $CH_3$ and n is an integer ranging from 1 to 1000, and (b) recovering a clean oil product containing less than 5 pounds of salt per thousand barrels of crude, said Relative Solubility Number being the amount of water in ml required to reach the cloudpoint at 25° C. of the solution of 1 gram of said demulsifier dissolved in 30 ml of a solvent system made up of 4% xylene in dioxane.

6. A process according to claim 5 wherein an aqueous emulsion of said oil and water containing said admixture is heated to from 35° C. to 150° C. prior to recovering said product.

7. A process according to claim 6 wherein said aqueous emulsion containing said admixture is subjected to the further step of passing said emulsion through an electrostatic coalescer.

8. The process of claim 5 wherein the deoiler and demulsifier are added to the oil in concentration ranging from about 3 ppm to about 35 ppm.

9. The process of claim 5 wherein the ratio of deoiler to demulsifier ranges from 0.05 to twenty parts by weight of deoiler to each part by weight of demulsifier.

10. The process of claim 9 wherein the ratio of deoiler to demulsifier ranges from 0.2 to five parts of polyol per part of demulsifier.

11. The process of claim 5 wherein said aqueous admixture contains from 1 to 10 weight percent of a cosolvent, said weight percent based on the sum total weight of the deoiler and demulsifier.

12. A process according to claim 5 wherein said aqueous admixture is introduced with wash water, said wash water introduced into said oil so as to produce a water in oil emulsion.

13. A process according to claim 12 wherein said wash water is introduced both prior to and after heating of said oil to a temperature of from 35° C. to 150° C.

14. A process according to claim 7 wherein said emulsion is maintained at a temperature ranging from about 110° C. to about 145° C. for a period ranging from about 15 minutes to about 35 minutes while passing through said coalescer.

15. An aqueous formulation suitable for the desalting of petroleum crudes and residua comprising a water-soluble alkylene oxide alkyl phenol-formaldehyde condensate demulsifier having a Relative Solubility Number ranging from 13 to 30, said Relative Solubility Number being the amount of water in ml required to reach the cloudpoint at 25° C. of the solution of 1 gram of said demulsifier dissolved in 30 ml of a solvent system made up of 4% xylene in dioxane said demulsifier being combined with a deoiler having a formula $$HO\left(CH_2-\underset{\substack{|\\ R}}{CH}-O\right)_n H$$

wherein R is H or $CH_3$ and n is an integer of 1 to 1000, the weight ratio of deoiler to said demulsifier ranging from 1:20 to 20:1.

16. The aqueous formulation of claim 15 wherein said deoiler is ethylene glycol.

17. An aqueous formulation according to claim 15 wherein 1 to 10 weight percent of a cosolvent is present, said weight percent based on the sum total weight of said deoiler and said demulsifier.

18. An aqueous formulation according to claim 17 wherein said poly(ethylene glycol) has a $\overline{M}w$ of about 600 and is present in about 18 weight percent, said condensate has 10 moles of ethylene oxide per mole of phenol-formaldehyde adduct and is present in about 21 weight percent, said cosolvent is isopropanol and present in about 4 weight percent and the balance is water, said weight percent based on the total weight of the formulation.

19. An aqueous formulation according to claim 17 wherein said deoiler is ethylene glycol and is present in about 25 weight percent, said demulsifier is a phenol-formaldehyde resin condensate with about 10 moles of ethylene oxide per mole of resin and is present in about 25 weight percent and the balance is water.

20. The aqueous formulation according to claim 15 wherein said deoiler is poly(ethylene glycol) having a Mw ranging from 106 to 4,500 and said demulsifier is an ethoxylated nonylphenol-formaldehyde condensate having a Relative Solubility Number of 17 to 20, said Relative Solubility Number being the amount of water in ml required to reach the cloudpoint at 25° C. of the solution of 1 gram of said demulsifier dissolved in 30 ml of a solvent system made up of 4% xylene in dioxane.

* * * * *

UNITED STATES PATENT OFFICE

CERTIFICATE OF CORRECTION

Patent No. 4,551,239 Dated November 5, 1985

Inventor(s) Phillip Merchant and Sylvia M. Lacy

It is certified that error appears in the above-identified patent and that said Letters Patent are hereby corrected as shown below:

Claim 2, Column 12, line 37, the number "1000" should read --100--.

Claim 5, Column 12, line 65, the number "1000" should read --100--.

Claim 15, Column 14, line 10, the number "1000" should read --100--.

Signed and Sealed this

First Day of December, 1987

*Attest:*

DONALD J. QUIGG

*Attesting Officer*

*Commissioner of Patents and Trademarks*